United States Patent [19]

Griese et al.

[11] Patent Number: 4,958,994

[45] Date of Patent: Sep. 25, 1990

[54] GEAR MACHINE FOR A PUMP OR ENGINE HAVING BEARING MEMBERS WITH CIRCUMFERENTIAL RELIEF GROOVES

[75] Inventors: Klaus Griese, Kupferzell; Claus Jöns, Sachsenheim; Karl-Heinz Müller, Vaihingen; Rudolf Müller, Remseck; Werner Mühlbauer, Schwieberdingen, all of Fed. Rep. of Germany

[73] Assignee: Robert Bosch GmbH, Stuttgart, Fed. Rep. of Germany

[21] Appl. No.: 378,181

[22] PCT Filed: Jan. 7, 1988

[86] PCT No.: PCT/DE88/00007

§ 371 Date: Jun. 26, 1989

§ 102(e) Date: Jun. 26, 1989

[87] PCT Pub. No.: WO88/05501

PCT Pub. Date: Jul. 28, 1988

[30] Foreign Application Priority Data

Jan. 16, 1987 [DE] Fed. Rep. of Germany ..... 3701099

[51] Int. Cl.[5] ..... F04C 2/18; F04C 15/00

[52] U.S. Cl. ..... 418/132

[58] Field of Search ..... 418/132, 131

[56] References Cited

U.S. PATENT DOCUMENTS

| | | | |
|---|---|---|---|
| 2,974,605 | 3/1961 | Murray | 418/131 |
| 3,499,390 | 3/1970 | Prijatel | 418/132 |
| 3,961,872 | 6/1976 | Müller et al. | 418/132 |
| 4,108,582 | 8/1978 | Bitton | 418/132 |
| 4,331,444 | 1/1982 | Shumate | 418/131 |
| 4,605,363 | 8/1986 | Walsh | 418/131 |

FOREIGN PATENT DOCUMENTS

| | | |
|---|---|---|
| 2344732 | 3/1977 | France . |
| 1177022 | 1/1970 | United Kingdom . |
| 2033478 | 5/1980 | United Kingdom . |

*Primary Examiner*—John J. Vrablik
*Assistant Examiner*—David L. Cavanaugh
*Attorney, Agent, or Firm*—Michael J. Striker

[57] ABSTRACT

The gear machine comprises a housing in which two gears mounted on shaft journals mesh. The shaft journals are supported in bushing or eyeglass-shaped bearing members. Located between the latter and the lateral surfaces of the gears are sealing plates which are brought into sealing contact with the lateral surfaces of the gears by axially-acting pressure fields. Relief grooves are formed circumferentially in the outer circumference of the bearing members and are spaced from and adjacent to the sealing plates. These relief grooves communicate with the low-pressure sdide of the gear machine and attain an optimal sealing action.

5 Claims, 2 Drawing Sheets

GEAR MACHINE FOR A PUMP OR ENGINE HAVING BEARING MEMBERS WITH CIRCUMFERENTIAL RELIEF GROOVES

BACKGROUND OF THE INVENTION

The invention relates to a gear machine(pump or engine).

A gear machine(pump or engine) is known comprising two gears mounted on shaft journals. The gears mesh and their shaft journals are supported in bushing or eyeglass-shaped bearing members. A sealing plate is located on at least one side of the gears between the lateral surfaces of the gears and the adjacent bearing members. The sealing plate is brought into sealing contact with the lateral surfaces of the gears by an sealing plate and the bearing member and which is limited by a seal arrangement.

In the known gear machine the radial contact pressure at the seal arrangement and the sealing plate may be faulty, i.e., may be insufficient, so that a certain counter-pressure can disadvantageously build up at the seal arrangement and the sealing plate.

SUMMARY OF THE INVENTION

It is an object of the present invention to provide a gear machine(pump or engine) of the above-described type, in which the radial contact pressure at the seal arrangement and the sealing plate is satisfactory.

In keeping with this object and with others which will become apparent hereinafter, the gear machine further comprises a circumferentially-extending, relief groove in the outer circumference of the adjacent bearing member. The relief groove is adjacent and spaced from the sealing plate and communicates with the low-pressure side, e.g., by the gap between the housing and the bearing member.

In the gear machine according to our invention the axial pressure field is sealed in a more perfect manner. Specifically the steep pressure differential between the sealing plate and the relief groove causes the sealing element to press radially against the housing in a forceful manner. Accordingly, an increase in the power of the machine is possible along with higher pressures, higher speeds and lower losses.

The seal arrangement advantageously comprises a shaped sealing element of a resilient material having a U-shaped transverse cross section and shaped like a "3". This sealing element can be embedded in a supporting element of a comparatively harder material which contacts on the bearing member.

Also advantageously one of the sealing plates is located on both sides of the gears.

DETAILED DESCRIPTION OF THE INVENTION

Figure 1:
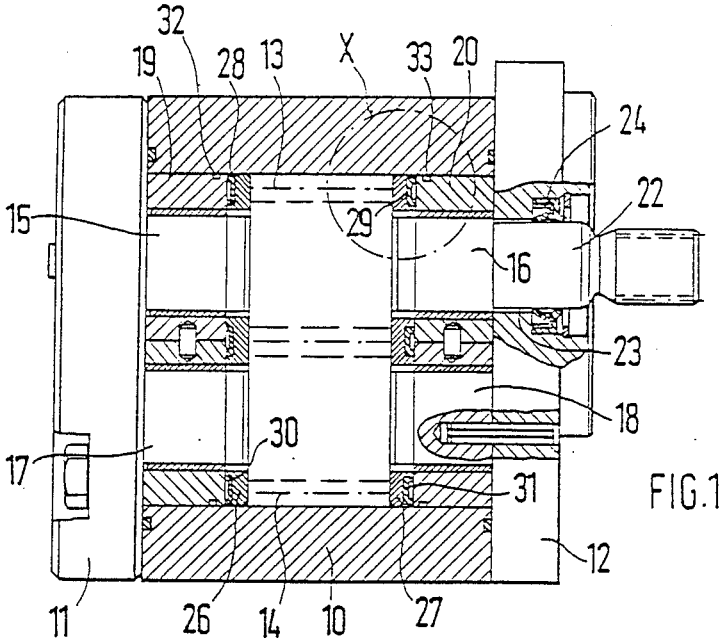
FIG. 1 is a longitudinal cross sectional view through a gear machine (pump or engine) according to our invention.

The gear machine shown in the drawing comprises a housing 10 which is closed on both sides by covers 11 and 12. Two gears 13 and 14 mesh each having two lateral surfaces 13', 13" or 14', 14" on opposite sides at their outer peripheral edges in the housing 10, their shaft journals 15 to 18 being supported in bushing or eyeglass-shaped bearing members 19,20. The shaft journal 16 has a continuation 22 with which it projects through a drilled hole 23 in the cover and drives the gear machine. The shaft seal 24 is located in a widened portion of the drilled hole 23.

A sealing plate 26 or 27 is located between each pair of bearing members 19 or 20 and the lateral surfaces of the gears. A seal arrangement 28,29 is located between every sealing plate and the adjacent bearing members; axially acting pressure fields 30,31 are built up in a known manner by a seal arrangement and bring the sealing plates 26,27 into sealing contact with the lateral surfaces of the gears 13,14. Leakage losses are accordingly reduced to a great extent relative to the current gear machine of this type.

To further improve the sealing action of the pressure fields 30,31 a circularly-extending relief groove 32,33 is formed in each instance in the outer circumference of every bearing member 19,20 as close as possible to its end face facing the sealing plate. These relief grooves 32,33 communicate with the low-pressure side of the gear machine, either via a gap between the bearing member and the housing which is always there or via a longitudinal groove which is not shown in more detail.

Figure 2:
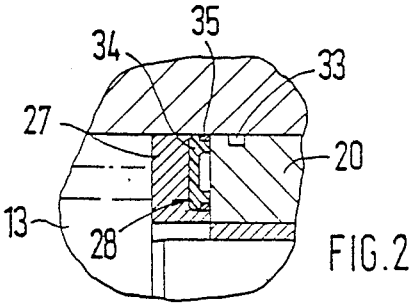
FIG. 2 is a detailed cross sectional view of a portion of the apparatus of FIG. 1 indicated by the dot-dashed circle X in FIG. 1.
Figure 3:
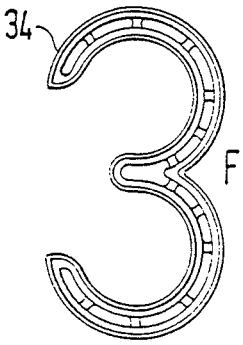
FIG. 3 is a plan view of a sealing element.
Figure 4:
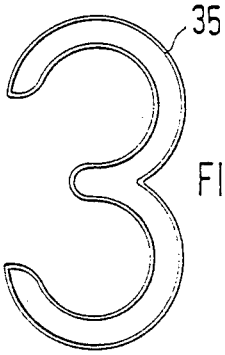
FIG. 4 is a plan view of a supporting element for the sealing element of FIG. 3.
Figure 5:
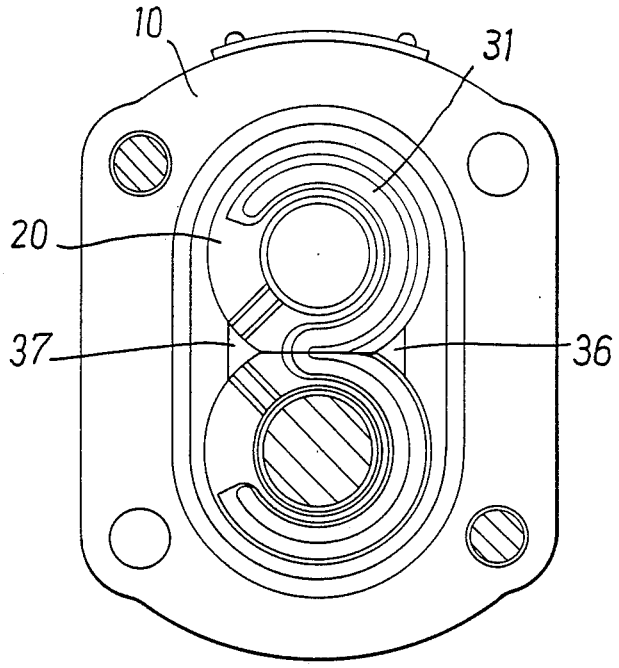
FIG. 5 is a plan view of a bearing member for the gear machine with the seal arrangement shown in FIGS. 3 and 4 taken along the section line V—V of FIG. 1.

The seal arrangement 28 is shown in detail in FIGS. 2 to 4. It comprises a shaped sealing element 34 made of a resilient material in the shape of a "3" and has a U-shaped transverse cross section as is particularly apparent in FIG. 2. This shaped sealing element 34 is embedded in a supporting element 35 consisting of a harder material, e.g., PTFE. The shaped sealing element 34 contacts the sealing plate 27 with its rear side, while the supporting element 35 faces the bearing member 20. The relief groove 33 can also be recognized clearly in FIG. 2. It has a comparatively small height and depth, which is completely sufficient for a relief effect.

In operation the bearing members 19,20 are pushed from the high-pressure side 36 toward the low-pressure or suction side 37. Because of that a very small gaps is formed on the high-pressure side. Pressurized medium, which leaks through to the sealing plates 26 and 27, arrives in the relief grooves 32, 33, and flows away from there into a small gaps, from where it flows into the low-pressure interior of the housing. Thus it is a matter of an extremely small leakage amount, so that the efficiency loss caused by the oil leak remains small.

It will be understood that each of the elements described above, or two or more together, may also find a useful application in other types of structures differing from the types described above.

While the invention has been illustrated and described as embodied in a gear machine(pump or engine), it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed as new and desired to be protected by Letters Patent is set forth in the appended claims.

1. A gear machine having a high-pressure side and a low-pressure side, comprising two meshing gears having two opposing lateral surfaces, a plurality of shaft journals on which said gears are mounted, each of said meshing gears being mounted on at least one of said shaft journals, a plurality of bearing members in which said shaft journals are supported, a sealing plate located between at least one of said lateral surfaces of said gears and an adjacent one of said bearing members and a seal arrangement located between each of said sealing plates and said adjacent bearing member, said sealing plate and said seal arrangement being structured so that said sealing plate is brought into sealing contact with said lateral surface of said gear by an axially-acting pressure field formed between said sealing plate and said bearing member and so that said seal arrangement acts to limit said axially-acting pressure field, each of said bearing members having a circumferentially-extending relief groove in its outer circumference spaced from the adjacent to said sealing plate which connects and communicates with said low-pressure side of said gear machine when said gear machine is under load.

2. The improvement according to claim 1 further comprising a supporting element made of a comparatively hard material and in which said seal arrangement comprises a shaped sealing element of a resilient material having a U-shaped transverse cross section and shaped like a "3", said sealing element being embedded in said supporting element.

3. The improvement according to claim 1 in which one of said sealing plates is located on each side of said gears.

4. The improvement according to claim 1 wherein said bearing member is eyeglass-shaped.

5. The improvement according to claim 1 wherein said bearing member is bushing-shaped.

* * * * *